US006669491B2

(12) United States Patent
Yoji

(10) Patent No.: US 6,669,491 B2
(45) Date of Patent: Dec. 30, 2003

(54) POWER PLUG

(75) Inventor: Nishimuru Yoji, Tokyo (JP)

(73) Assignee: Furutech Co., LTD, Tokyo (JP)

( * ) Notice: Subject to any disclaimer, the term of this patent is extended or adjusted under 35 U.S.C. 154(b) by 0 days.

(21) Appl. No.: 10/066,633

(22) Filed: Feb. 6, 2002

(65) Prior Publication Data

US 2003/0148643 A1 Aug. 7, 2003

(51) Int. Cl.[7] ..... H01R 4/66
(52) U.S. Cl. ..... 439/106
(58) Field of Search ..... 439/106, 107, 439/650, 45, 101, 102, 105, 108, 695, 696, 610

(56) References Cited

U.S. PATENT DOCUMENTS 3,461,417 A * 8/1969 Schumacher et al. ..... 439/105

* cited by examiner

*Primary Examiner*—Ross Gushi
(74) *Attorney, Agent, or Firm*—Birch, Stewart, Kolasch & Birch, LLP

(57) ABSTRACT

A power plug is proposed, including a terminal base having at least one conductive terminal and a ground terminal; an electric wire having core wires connected to the conductive terminal and ground terminal, respectively; a cover integrally connected to the terminal base; and a ground mechanism for grounding isolated metal parts (such as screws). The ground mechanism can prevent quality of power provided through the power plug from being deteriorated by electromagnetic effect of the metal parts.

10 Claims, 12 Drawing Sheets

POWER PLUG

FIELD OF THE INVENTION

The present invention relates to power plugs, and more particularly, to a power plug for preventing quality deterioration of power supplied through the power plug.

BACKGROUND OF THE INVENTION

Recently, in the realm of audio equipment, much attention and concern are directed toward influence of power supply on audio quality, or timbre deterioration caused by instability of current passing through the audio equipment.

In response to the above problems, a power plug having stronger mechanical strength and stability is applied to the audio equipment, wherein joints or terminals of the power plug are preferably made for reducing electrical resistance of current flow; this desirably improves timbre, resolution and other critical properties of the audio equipment.

However, in order to enhance mechanical strength and stability, the foregoing power plug is internally provided with a plurality of metallic screws. When current from a power supply flows inside the power plug, a magnetic field produced by the current flow induces variation in internal electron energy levels of metal atoms of the metallic screws that are located nearby the current flow, whereby part of electrons in the metal atoms are ionized, and generates an electron flow inside the metallic screws. This electron flow accordingly produces a magnetic field, which interferes with stability of the current flow from the power supply, thereby leading to timbre deterioration of the audio equipment in operation of the power plug, so that satisfactory audio quality still cannot be achieved.

SUMMARY OF THE INVENTION

A primary objective of the present invention is to provide a power plug, in which a ground mechanism can prevent the occurrence of electron ionization in the power plug, allowing stability of current flowing through the power plug to be effectively assured.

In accordance with the foregoing and other objectives, the present invention proposes a power plug, comprising: a terminal base having at least one conductive terminal and a ground terminal; an electric wire having core wires connected to the conductive terminal and the ground terminal, respectively; a cover integrally connected to the terminal base by a plurality of first screws; and a ground mechanism having a conductive member for connecting the first screws to the ground terminal, allowing the first screws to be grounded. The conductive member of the ground mechanism is a copper plate, wherein a central portion of the copper plate is connected to the ground terminal, and two ends thereof can respectively extend to come into contact with the first screws.

Further, the conductive terminal and ground terminal of the terminal base can be in the form of a male or female power plug.

In another embodiment, the power plug of the invention further comprises a wire fixing mechanism installed in the cover, which wire fixing mechanism includes a press board positioned at where the electric wire passes thereby, and a clamping member underneath the press board; and two second screws respectively penetrating through the cover and screwed at two ends of the press board. The ground mechanism includes a first conductive member for connecting the first screws to the ground terminal, allowing the first screws to be grounded; a second conductive member for interconnecting the two second screws; and a third conductive member for connecting the first screws to the second conductive member, so as to ground the second screws via the second conductive member and the first screws. A central portion of the first conductive member is connected to the ground terminal, and two ends thereof can respectively extend to come into contact with the first screws. The second conductive member is a copper plate, and capable of extending to come into contact with the second screws, respectively. And, the second conductive member has a central portion thereof being exposed to one screw hole for allowing one of the first screws to be screwed therein; the third conductive member is a metallic spring installed in this screw hole, and is pressed when the first screw is screwed into the screw hole, in a manner that one end of the metallic spring abuts against the first screw, and the other end of the metallic spring adjoins the central portion of the second conductive member.

In a further embodiment, the power plug of the invention comprises: a terminal base having at least one conductive terminal and a ground terminal; an electric wire having core wires connected to the conductive terminal and the ground terminal, respectively; two covers integrally connected to the terminal base by a plurality of screws, and capable of being coupled to each other for enclosing the conductive terminal and the ground terminal therein; and a ground mechanism having a conductive member for connecting the screws to the ground terminal, allowing the screws to be grounded. The conductive member of the ground mechanism is a copper plate provided on an inner wall of one of the covers, wherein one end of the copper plate extends toward the ground terminal, and can be pressed to abut against the ground terminal when the two covers are coupled to each other, whereas the other end of the copper plate extends to screw holes, allowing the screws to be respectively screwed into the screw holes and come into contact with the copper plate.

In a further embodiment, the power plug of the invention comprises: a terminal base having at least one conductive terminal; an electric wire having core wires connected to the conductive terminal and a ground terminal, respectively; a cover integrally connected to the terminal base by a plurality of screws; a ground wire having one end thereof being connected to the ground terminal, and the other end thereof extending to outside of the power plug and connected to an external ground device; and a ground mechanism for connecting the screws to the ground terminal of the ground wire, allowing the screws to be grounded.

BRIEF DESCRIPTION OF THE DRAWINGS

The present invention can be readily understood by the following detailed description of the preferred embodiment, with reference made to the accompanying drawings, wherein.

DETAILED DESCRIPTION OF THE PREFERRED EMBODIMENTS

First Preferred Embodiment

Figure 1:
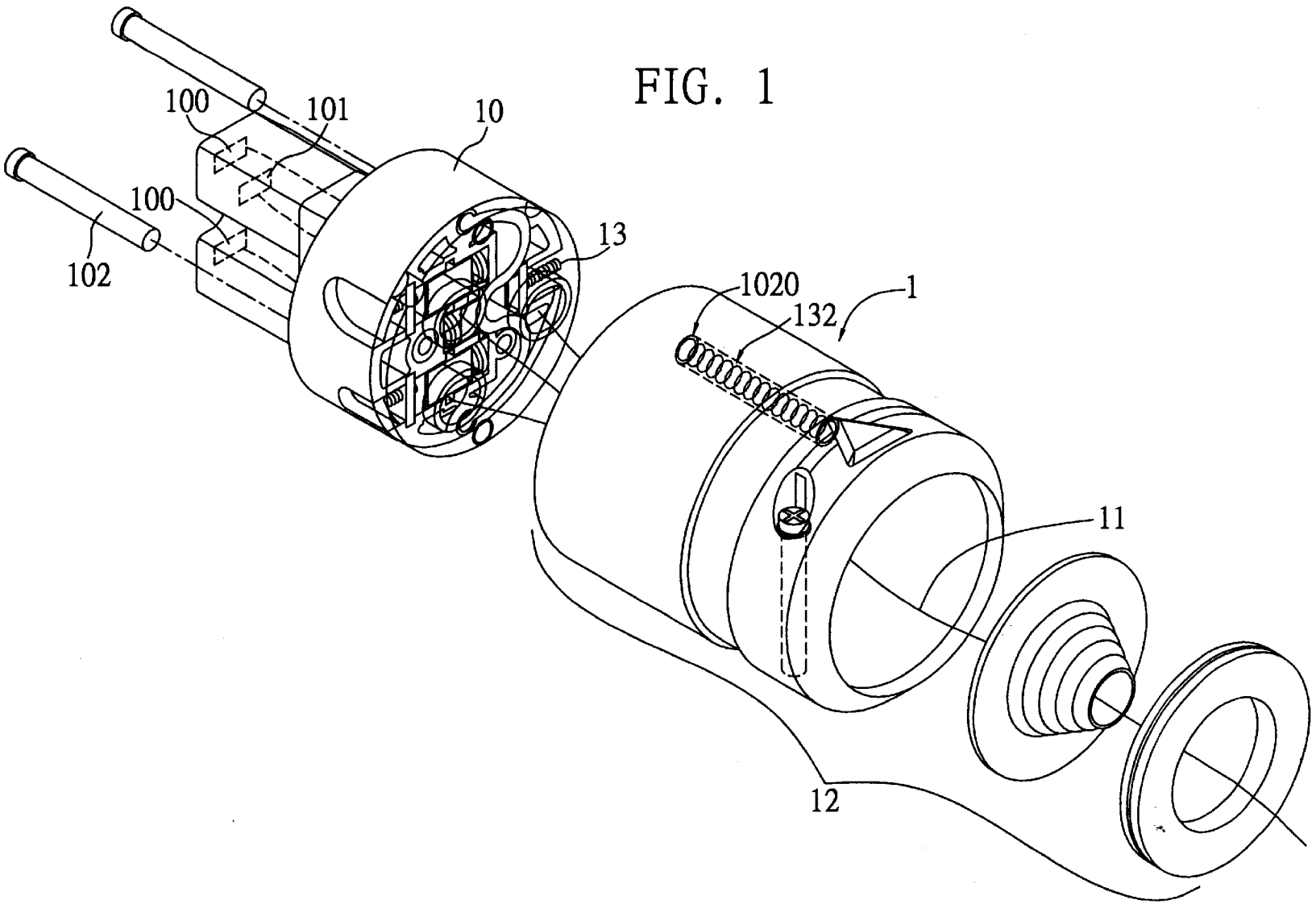
FIG. 1 is a perspective schematic diagram of a power plug of a first preferred embodiment of the invention.

Illustrated in FIG. 1 is a perspective schematic diagram of a power plug of a first embodiment of the present invention. As shown in the drawing, the power plug 1 comprises a terminal base 10 having two conductive terminals 100 and a ground terminal 101; an electric wire 11 having core wires connected to the conductive terminals 100 and the ground terminal 101, respectively; a cover 12 integrally connected to the terminal base 10 by a plurality of first screws 102; and a ground mechanism 13 for connecting the first screws 102 to the ground terminal 101, allowing the first screws 102 to be grounded.

Figure 2:
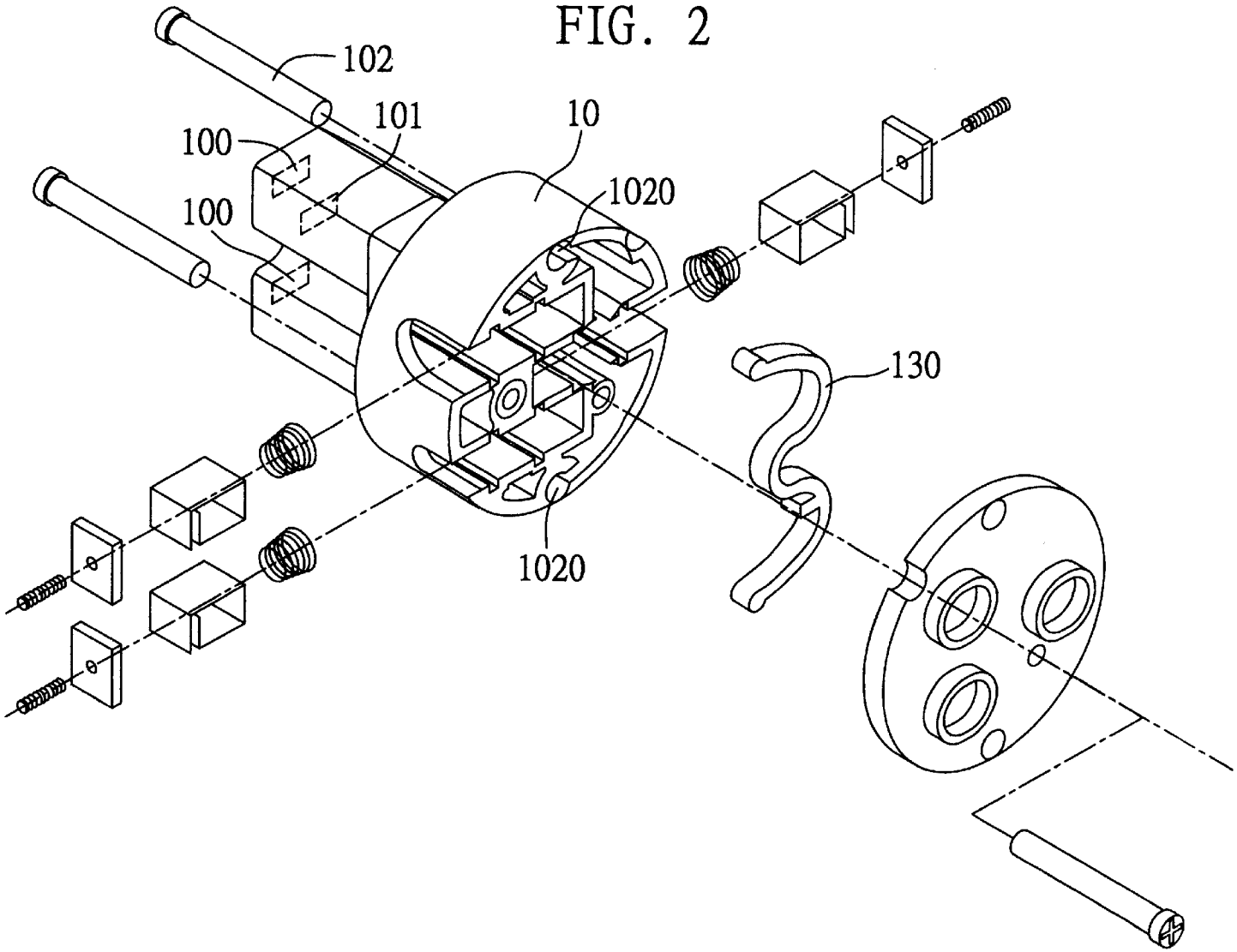
FIG. 2 is a perspective dissection diagram showing a terminal base with a ground mechanism in a power plug of a first preferred embodiment of the invention.
Figure 3:
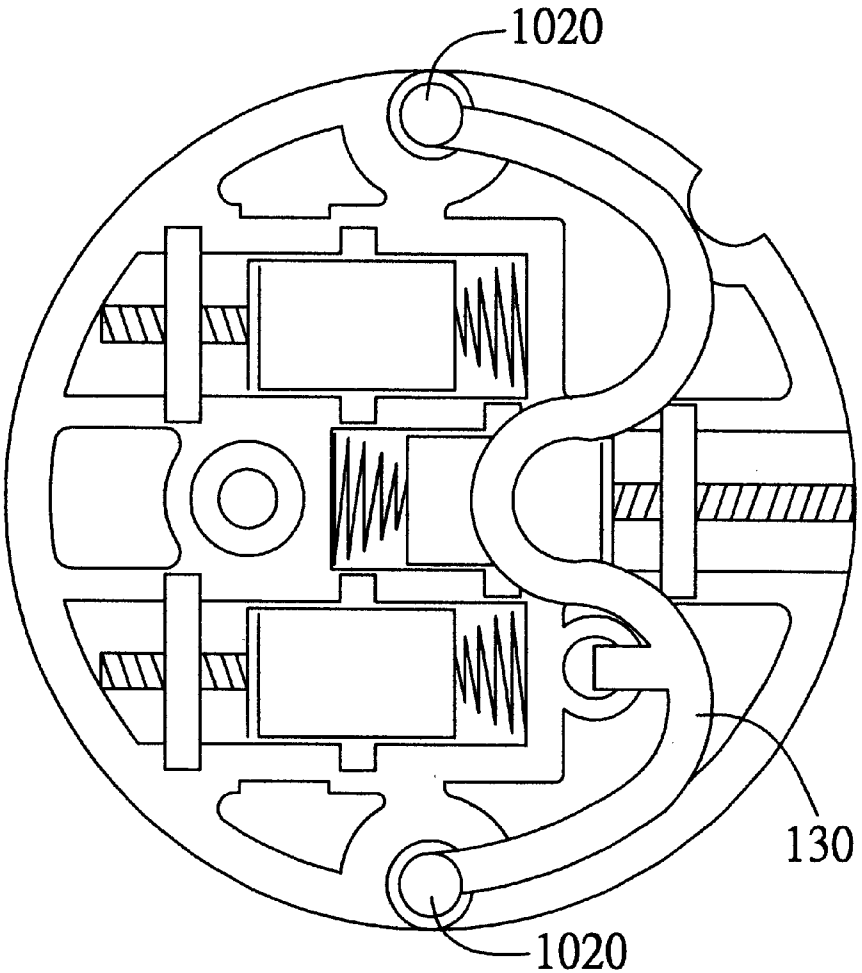
FIG. 3 is a cross-sectional view of a terminal base with a ground mechanism in a power plug of a first preferred embodiment of the invention.

FIG. 2 illustrates a perspective dissection diagram of a terminal base with a ground mechanism in the power plug of the first embodiment of the invention; FIG. 3 illustrates a cross-sectional view of a terminal base with a ground mechanism in the power plug of the first embodiment of the invention. Referring to FIGS. 1, 2 and 3, the ground mechanism 13 includes a first conductive member 130 such as a copper plate for connecting the first screws 102 to the ground terminal 101. One end of the copper plate 130 is associated with the ground terminal 101, and the other end thereof extends to screw holes 1020 for allowing the first screws 102 to penetrate therethrough. This makes the first screws 102 come into contact with the copper plate 130 when being screwed into the screw holes 1020.

Furthermore, two of the first screws 102 are provided in the power plug 1. The first conductive member 130 is an approximately M-shaped copper plate, wherein a central portion of the copper plate 130 is connected to the ground terminal 101, and two ends thereof respectively extend to two screw holes 1020 where the first screws 102 can penetrate therethrough, so as to allow the first screws 102 to respectively screwed into the screw holes 1020 and come into contact with the copper plate 130.

Moreover, the conductive terminals 100 and the ground terminal 101 of the terminal base 10 are in the form of a female power plug.

Figure 4:
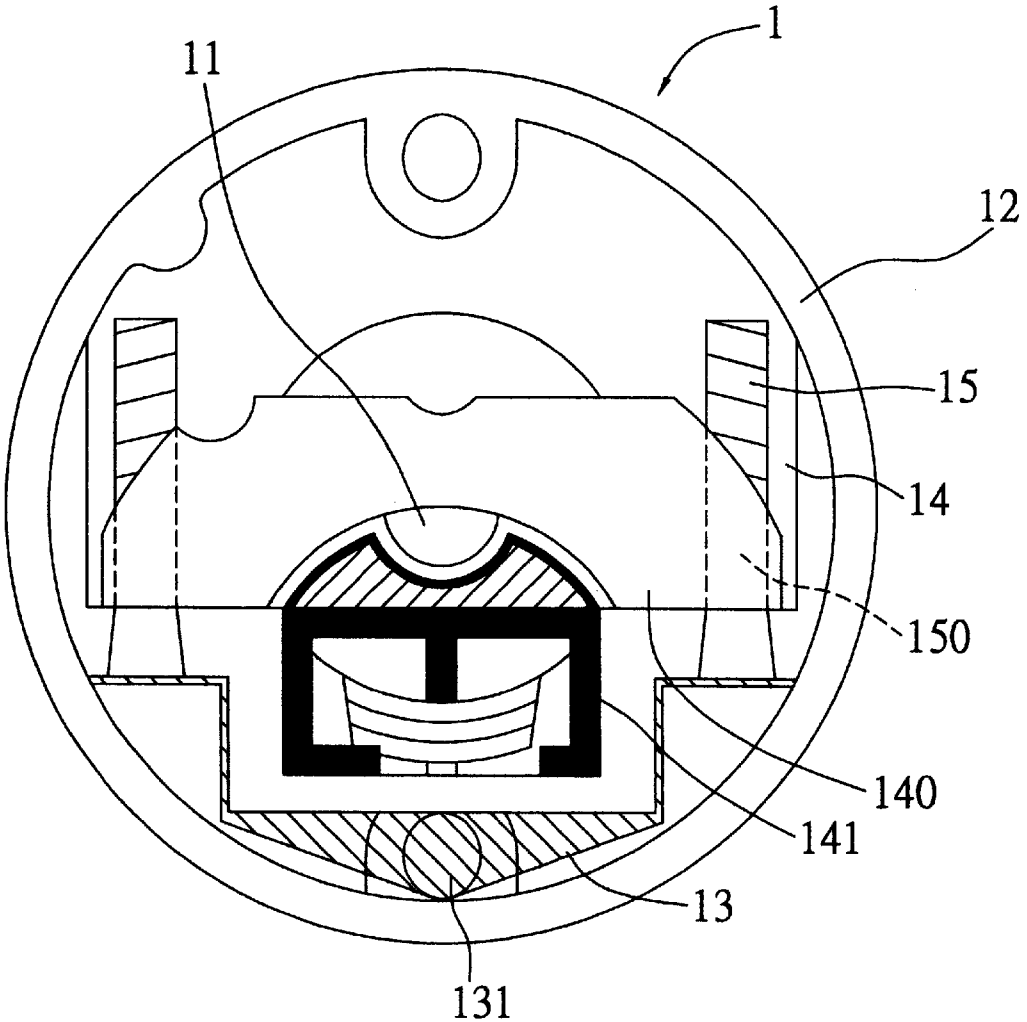
FIG. 4 is a cross-sectional view of an upper part of a cover in a power plug of a first preferred embodiment of the invention.

FIG. 4 illustrates a cross-sectional view of an upper part of a cover in the power plug of the first embodiment of the invention. Referring to FIGS. 2, 3 and 4, the power plug 1 further comprises: a wire fixing mechanism 14 installed in the cover 12, and two second screws 15. The wire fixing mechanism 14 includes a press board 140 positioned at where the electric wire 11 passes thereby, and a clamping member 141 underneath the press board 140. The two second screws 15 penetrate through the cover 12 and are screwed at two ends of the press board 140, respectively. By screwing tight the second screws 15, the press board 140 can be moved toward an inner wall of the cover 12, allowing the electric wire 11 to be fixed and abut against the inner wall of the cover 12, and to be firmly clamped by the clamping member 141.

Besides the above first conductive member 130 for allowing the first screws 102 to be grounded, the ground mechanism 13 further includes a second conductive member 131 for interconnecting the two second screws 15; and a third conductive member 132 for connecting the first screws 102 to the second conductive member 131, allowing the second screws 15 to be grounded via the second conductive member 131 and the first screws 102.

The second conductive member 131 is a copper plate, two ends of which copper plate 131 respectively extend to second screw holes 150 for allowing the two second screws 15 to penetrate therethrough. This makes the second screws 15 comes into contact with the copper plate 131 when being screwed into the second screw holes 150.

A central portion of the second conductive member 131 is exposed to one of the first screw holes 1020 used for screwing the first screws 102 therein. The third conductive member 132 is a metallic spring installed in the first screw hole 1020. When one of the first screws 102 is screwed into the first screw hole 1020, the metallic spring 132 is pressed, making one end thereof abut against the first screw 102, and the other end of the metallic spring 132 adjoin the central portion of the second conductive member 131.

Figure 5:
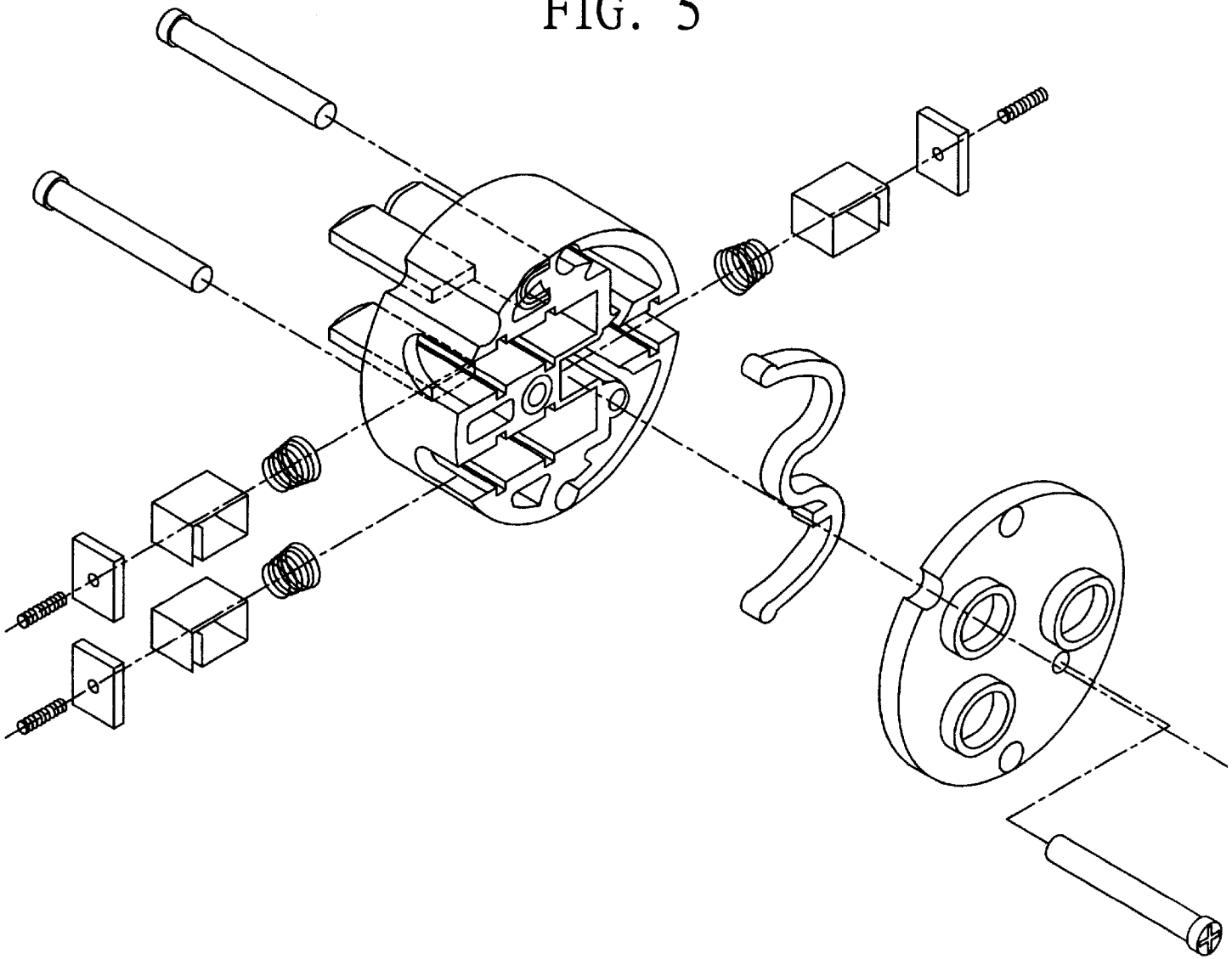
FIG. 5 is a perspective dissection diagram showing another example of a terminal base with a ground mechanism in a power plug of a first preferred embodiment of the invention.
Figure 6:
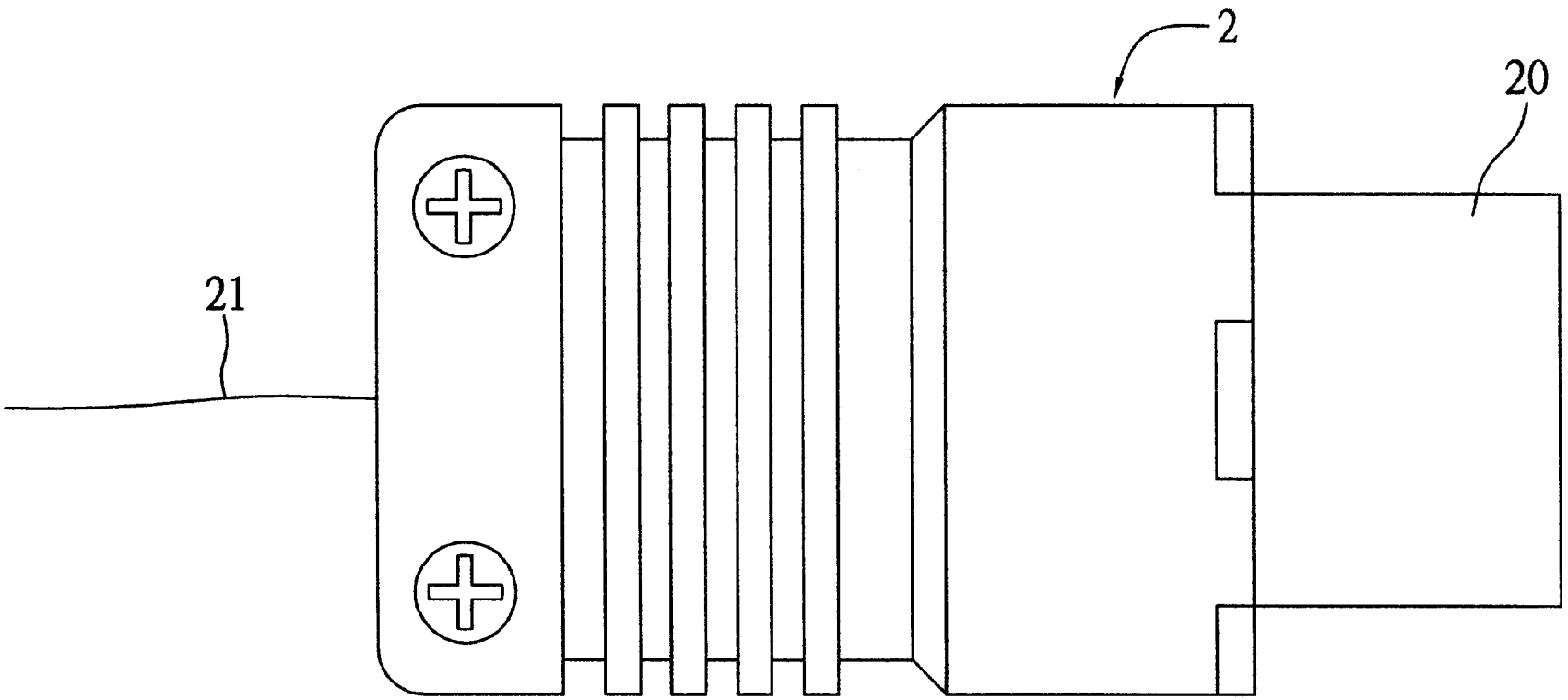
FIG. 6 is a top view of a power plug of a second preferred embodiment of the invention.
Figure 7:
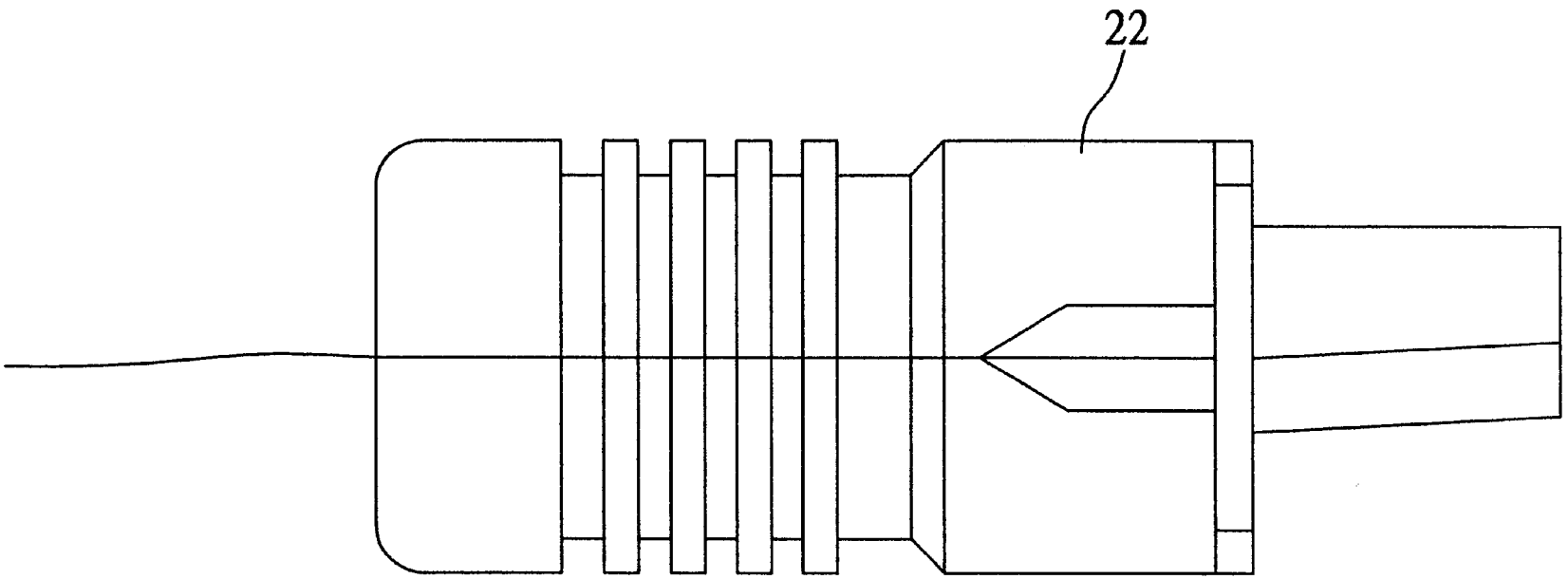
FIG. 7 is a side view of a power plug of a second preferred embodiment of the invention.
Figure 8:
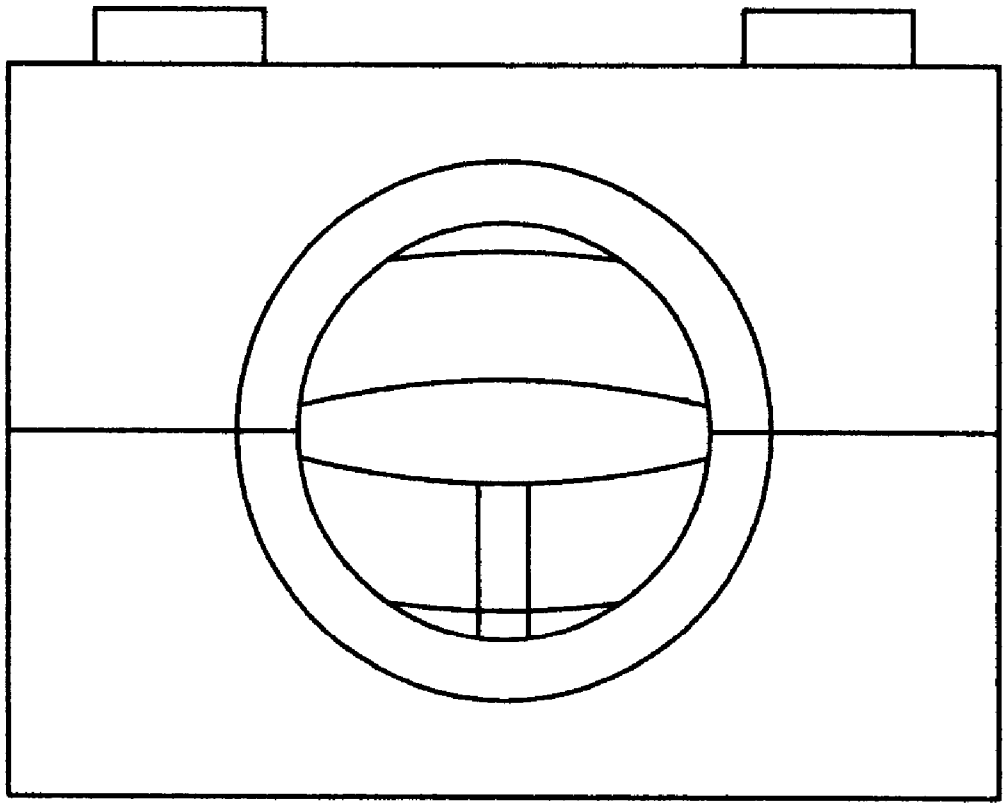
FIG. 8 is a front view of a power plug of a second preferred embodiment of the invention.
Figure 9:
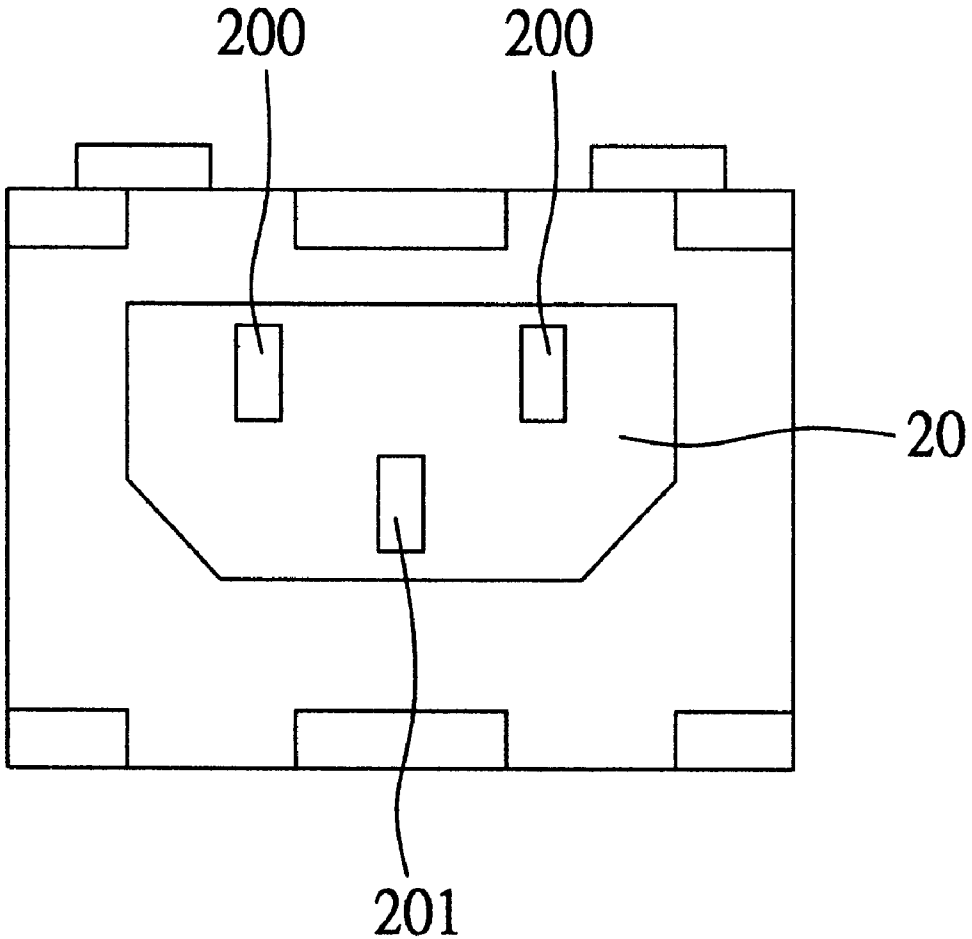
FIG. 9 is a back view of a power plug of a second preferred embodiment of the invention.

FIG. 5 is a perspective dissection diagram showing another example of a terminal base with a ground mechanism in the power plug of the first embodiment of the invention. As shown in the drawing, besides the above-mentioned female power plug, the conductive terminals 100 and the ground terminal 101 of the terminal base 10 can also be in the form of a male power plug.

Second Preferred Embodiment

Figure 10:
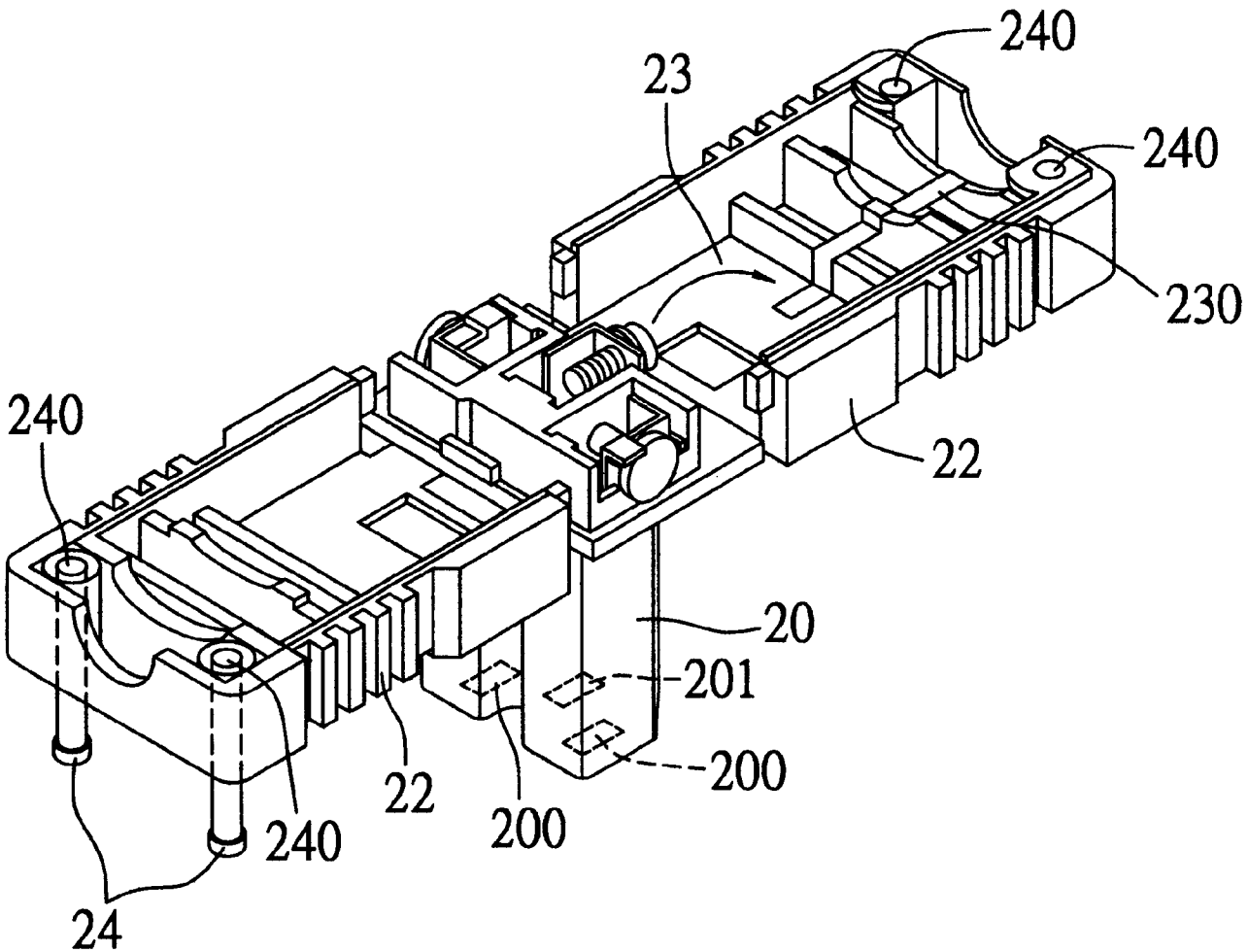
FIG. 10 is a perspective structural diagram showing an unassembled power plug of a second preferred embodiment of the invention.

FIGS. 6, 7, 8 and 9 are respectively a top view, a side view, a front view and a back view of a power plug of a second embodiment of the invention; FIG. 10 is a perspective structural diagram showing an unassembled power plug of the second embodiment of the invention. Referring to FIGS. 6 to 10, the power plug 2 of this embodiment comprises: a terminal base 20 having two conductive terminals 200 and a ground terminal 201; an electric wire 21 having core wires connected to the conductive terminals 200 and the ground terminal 201, respectively; two covers 22 integrally connected to the terminal base 20, which two covers 22 are capable of being coupled to each other by means of screws 24, so as to enclose the conductive terminals 200 and the ground terminal 201 therein; and a ground mechanism 23 for connecting the screws 24 to the ground terminal 201, so as to ground the screws 24.

Furthermore, the ground mechanism 23 includes a conductive member 230 for interconnecting the first screws 24 and the ground terminal 201. This conductive member 230 is a copper plate attached to an inner wall of one of the covers 22, wherein one end of the copper plate 230 extends toward the ground terminal 201, and is pressed to abut against the ground terminal 201 when the two covers 32 are engaged with each other, and the other end of the copper plate 230 extends to screw holes 240 for allowing the screws 24 to penetrate therethrough, whereby the screws 24 are made to come into contact with the copper plate 230 when being screwed into the screw holes 240.

In particular, two of the screws 24 are adopted in this embodiment, and alternatively, the conductive member 230 can be an approximately T-shaped copper plate provided on the inner wall of one of the covers 22. The vertical end of the T-shaped copper plate 230 extends toward the ground terminal 201, and is pressed to abut against the ground terminal 201 when the two covers 32 are engaged with each other; the other two ends of the copper plate 230 extend to the screw holes 240, allowing the two screws 24 to come into contact with the copper plate 230 when being respectively screwed into the screw holes 240.

Third Preferred Embodiment

Figure 11:
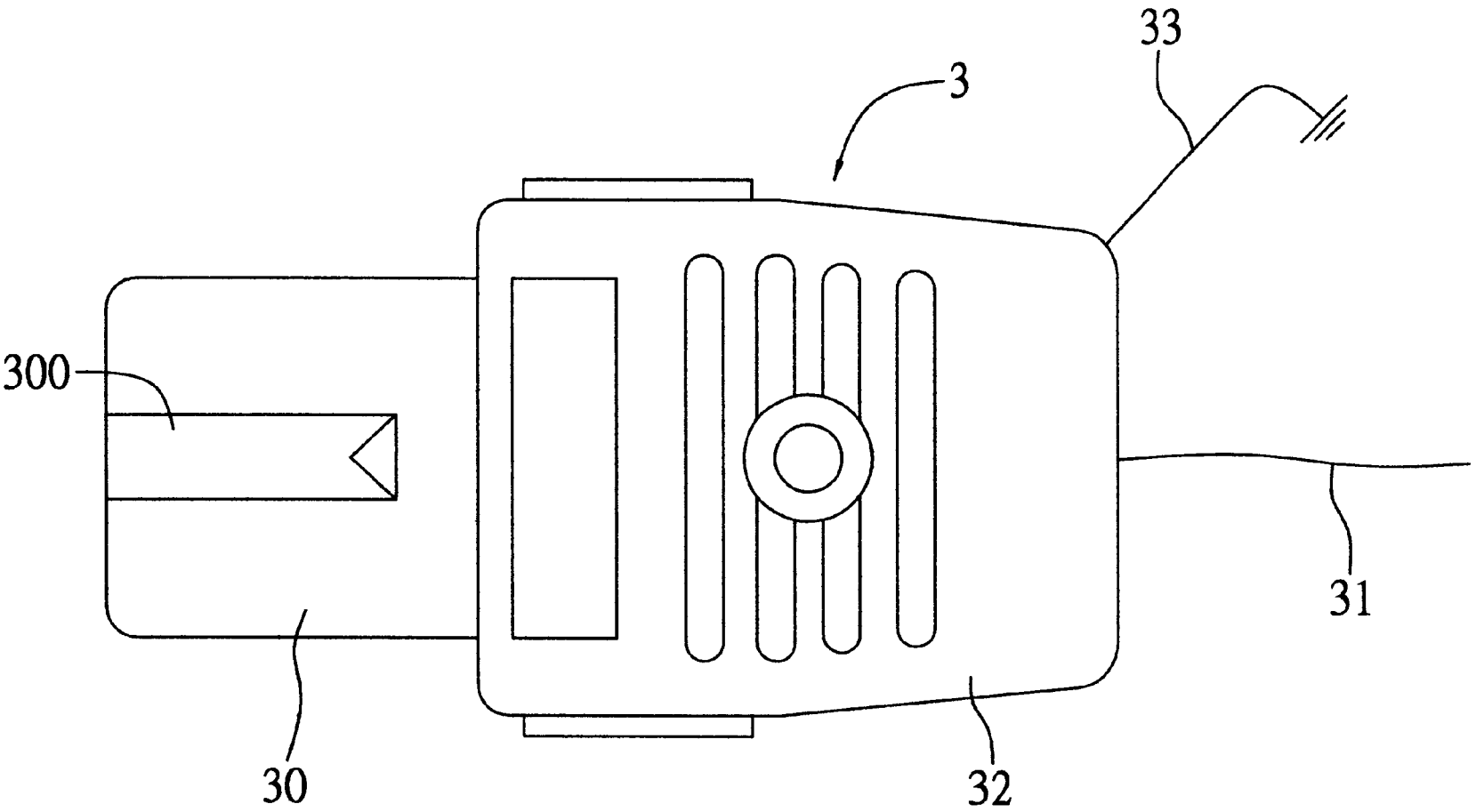
FIG. 11 is a top view of a power plug of a third preferred embodiment of the invention.
Figure 12:
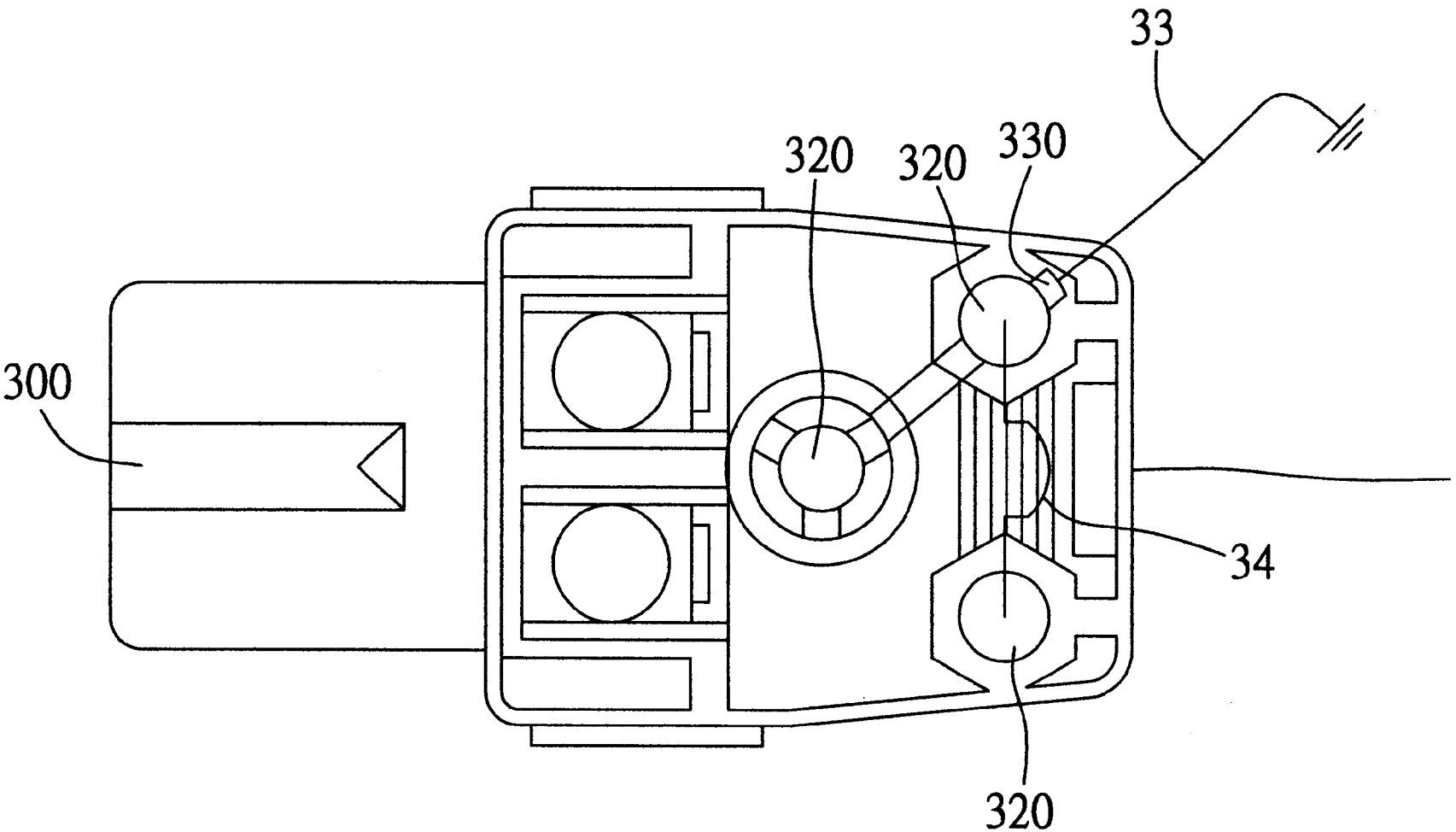
FIG. 12 is a cross-sectional view of a power plug of a third preferred embodiment of the invention.

Illustrated in FIGS. 11 and 12 are respectively a top view and a cross-sectional view of a power plug of a third embodiment of the invention. Referring to FIGS. 11 and 12, the power plug 3 comprises: a terminal base 30 having a conductive terminal 300; an electric wire 31 having core wires connected to the conductive terminal 300 and a ground terminal 330, respectively; a cover 32 integrally connected to the terminal base 30 by means of screws 320; a ground wire 33 having one end thereof connected to the ground terminal 330 inside the terminal base 30 and the cover 32; and a ground mechanism 34 for connecting the screws 320 to the ground terminal 330 of the ground wire 33, so as to ground the screws 320.

The power plug of the invention is characterized in the provision of a ground mechanism, which can solve a problem of electron ionization occurring in a conventional power plug as previously described, and further allow timbre quality of audio equipment to be effectively improved, whereby sounds generated from the audio equipment are clarified, especially for low bands to be more stable and sound. Moreover, in the use of the power plug of the invention, metal-induced interference with power or current passing through inside of the power plug and electric wires can be eliminated, allowing high quality of the clear original sounds to reappear.

In conclusion, the invention evidently provides positive and affirmative improvements in elevating and raising sound quality generated by the audio equipment.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A power plug, comprising:

a terminal base having at least one conductive terminal and a ground terminal;

an electric wire having core wires connected to the conductive terminal and the ground terminal, respectively;

a cover integrally connected to the terminal base by at least two first screws; and a ground mechanism including a conductive member for connecting the first screws to the ground terminal, allowing the first screws to be grounded, wherein the conductive member has a central portion thereof being connected to the ground terminal, and two ends thereof respectively extending to two screw holes, allowing the first screws to be respectively screwed into the screw holes and come into contact with the conductive member.

2. The power plug of claim 1, wherein the conductive member is an M-shaped copper plate.

3. The power plug of claim 1, wherein the cover is composed of a plurality of coupled parts.

4. The power plug of claim 1, further comprising:

a wire fixing mechanism installed in the cover, which wire fixing mechanism includes a press board positioned at where the electric wire passes thereby, and a clamping member underneath the press board; and two second screws respectively penetrating through the cover and screwed at two ends of the press board;

wherein the two second screws are screwed tight for making the press board move toward an inner wall of the cover, so as to press the electric wire to abut against the inner wall of the cover, and to be firmly clamped by the clamping member.

5. The power plug of claim 4, wherein the ground mechanism includes a first conductive member for connecting the first screws to the ground terminal, allowing the first screws to be grounded; a second conductive member for interconnecting the two second screws; and a third conductive member for connecting the first screws to the second conductive member, so as to ground the second screws via the second conductive member and the first screws.

6. The power plug of claim 5, wherein two of the first screws are provided in the power plug, and the first conductive member is a M-shaped copper plate, which copper plate has a central portion thereof being connected to the ground terminal, and two ends thereof respectively extending to two first screw holes, allowing the two first screws to be respectively screwed into the first screw holes and come into contact with the copper plate.

7. The power plug of claim 6, wherein the second conductive member is a copper plate, which copper plate has two ends thereof respectively extending to two second screw holes, allowing the two second screws to be respectively screwed into the second screw holes and come into contact with the copper plate.

8. The power plug of the claim 7, wherein the second conductive member has a central portion thereof being exposed to one of the first screw holes, and the third conductive member is a metallic spring installed in this first screw hole, and is pressed when one of the first screws is screwed into the first screw hole, in a manner that one end of the metallic spring abuts against the first screw, and the other end of the metallic spring adjoins the central portion of the second conductive member.

9. A power plug, comprising:

a terminal base having at least one conductive terminal;

an electric wire having core wires connected to the conductive terminal and a ground terminal, respectively;

a cover integrally connected to the terminal base by a at least two screws;

a ground wire having one end thereof being connected to the ground terminal, and the other end thereof extending to outside of the power plug and connected to an external ground device; and a ground mechanism including a conductive member for connecting the screws to the ground terminal of the ground wire, allowing the screws to be grounded, wherein the conductive member has a central portion thereof being connected to the ground terminal, and two ends thereof respectively extending to two screw holes, allowing the screws to be respectively screwed into the screw holes and come into contact with the conductive member.

10. The power plug of claim 9, wherein the conductive member is an M-shaped copper plate.

* * * * *